US006808176B2

(12) United States Patent
Billig et al.

(10) Patent No.: US 6,808,176 B2
(45) Date of Patent: Oct. 26, 2004

(54) ENTRAPMENT DEVICE HAVING A NET

(75) Inventors: Daniel A. Billig, Maplewood, MN (US); Michael L. Billig, Austin, TX (US)

(73) Assignee: DyscNet Inc., Maplewood, MN (US)

( * ) Notice: Subject to any disclaimer, the term of this patent is extended or adjusted under 35 U.S.C. 154(b) by 0 days.

(21) Appl. No.: 10/209,777

(22) Filed: Jul. 31, 2002

(65) Prior Publication Data

US 2003/0025272 A1 Feb. 6, 2003

Related U.S. Application Data

(60) Provisional application No. 60/309,106, filed on Jul. 31, 2001.

(51) Int. Cl.[7] ..... A63B 67/06
(52) U.S. Cl. ..... 273/400; 473/46
(58) Field of Search ..... 273/398–402, 273/197, 198, 172, 170, 150–155; 473/46

(56) References Cited

U.S. PATENT DOCUMENTS

| | | | | | |
|---|---|---|---|---|---|
| 1,211,379 | A | * | 1/1917 | Maisch | 273/368 |
| 4,039,189 | A | | 8/1977 | Headrick et al. | |
| 4,461,484 | A | | 7/1984 | Headrick | |
| 4,792,143 | A | | 12/1988 | Headrick | |
| 4,949,979 | A | | 8/1990 | Wheatcroft | |
| 5,048,845 | A | | 9/1991 | Dunipace | |
| 5,303,931 | A | | 4/1994 | Brown | |
| 5,358,255 | A | | 10/1994 | Jolson | |
| 5,397,130 | A | | 3/1995 | Brown | |
| 5,868,395 | A | | 2/1999 | Headrick | |
| 5,921,551 | A | | 7/1999 | Dunipace | |
| 6,343,998 | B1 | * | 2/2002 | Tarulli et al. | 473/273 |
| 6,468,165 | B1 | * | 10/2002 | Moore | 473/170 |
| 6,554,285 | B2 | * | 4/2003 | Chittenden | 273/400 |
| 2003/0008721 | A1 | * | 1/2003 | Macaluso | 473/197 |

* cited by examiner

*Primary Examiner*—Mark S. Graham
(74) *Attorney, Agent, or Firm*—Dicke, Billig & Czaja, PLLC

(57) ABSTRACT

An entrapment device for entrapping projectile or flying objects employed in a game, such as flying discs employed in the game of disc golf, comprises an entrapment frame assembly including a top basket support and a bottom basket support. The entrapment device comprises a net attachable to the top basket support and having an entrapment zone portion adapted to absorb kinetic energy from the projectile or flying object to cause the projectile or flying object to drop into and be entrapped in the bottom basket support.

39 Claims, 9 Drawing Sheets

ENTRAPMENT DEVICE HAVING A NET

CROSS-REFERENCE TO RELATED APPLICATIONS

This non-provisional application claims the benefit of the filing date of Provisional U.S. Patent Application Ser. No. 60/309,106, entitled "ENTRAPMENT DEVICE HAVING A NET," having a filing date of Jul. 31, 2001, and which is herein incorporated by reference.

THE FIELD OF THE INVENTION

The present invention generally relates to entrapment devices for entrapping projectile or flying objects in games or sports, and more particularly, to a 360 degree entrapment device, such as employed to entrap flying discs, such as flying discs used in the sport of disc golf.

BACKGROUND OF THE INVENTION

The sport of disc golf has become increasing more popular in recent years. Disc golf is typically played on courses laid out in parks, other recreational areas, or on areas specifically constructed as disc golf courses. Disc golf courses typically include a certain number of holes similar to a golf course, such as a 9-hole or 18-hole course. Each hole on the disc golf course typically includes a tee from which a player throws a flying disc toward a 360 degree entrapment device. Similar to the game of golf, on properly laid out disc golf courses, the flying disc is not typically entrapped in the entrapment device on the first throw. Thus, the disc is picked up and thrown again from where it lands toward the entrapment device for the particular hole. The player keeps on throwing from the landing place towards the entrapment device until the disc is entrapped by the entrapment device. Typically, the number of throws taken by a given player to land the disc in the entrapment device are added to provide the total score for that player for the given hole. Similar to golf, the winning player is typically the player with the lowest total score for all holes.

One type of conventional disc 360 degree entrapment device includes a center pole, a lower basket, and an upper support structure from which a plurality of loosely hanging chains are disposed above the basket. The chains are typically functionally arranged to effectively catch a flying disc by absorbing the disc's kinetic energy and dropping the disc into the basket.

The increasing popularity of disc golf in recent years has spurred improvements to discs and the disc entrapment devices. Players can select from numerous types of flying discs varying in design, size, and weight. Many types of complex disc entrapment devices have been designed in the attempt to more effectively absorb the kinetic energy of the wide variety of flying discs and the wide variety of throwing techniques. The majority of the disc entrapment devices employ chains as the entrapment apparatus to absorb the kinetic energy from the flying disc.

The tolerance for an occasional rejection of a well thrown disc by the disc entrapment device has diminished as the skill of the professional or serious amateur disc golfer has increased. In addition, in recent years there are many more social and recreational disc golf players who use light flying discs which are easier for the recreational player to control. Many times, a lighter disc does not have sufficient mass to overcome the mass of the chains and is consequently rejected by the entrapment device.

Most conventional flying disc entrapment devices are permanently mounted into the ground. Moreover, the chains of the entrapment device are typically heavy and make the device more cumbersome.

As a result, most conventional chain entrapment devices are not suitable as a portable entrapment device. Furthermore, flying discs can be damaged over time from repeated striking of the disc into the chains of the entrapment device. The flying discs striking the chains can also be quite noisy.

For reasons stated above and for other reasons presented in the Description of the Preferred Embodiment section of the present specification, there is a desire for an improved 360 degree entrapment device for sports, such as disc golf. There is particularly, a desire for a flying disc entrapment device which is less costly and is more portable yet still has a high degree of catchability desired by the serious amateur or professional disc golfer. An improved portable disc entrapment device is desired which would be better suited for use in areas other than specifically constructed disc golf courses.

SUMMARY OF THE INVENTION

One aspect of the present invention provides an entrapment device for entrapping projectile or flying objects employed in a game. The entrapment device comprises an entrapment frame assembly and a net. The entrapment frame assembly includes a top basket support and a bottom basket support. The net is attachable to the top basket support. The net has an entrapment zone portion adapted to absorb kinetic energy from the projectile or flying object to cause the projectile or flying object to drop into and be entrapped in the bottom basket support.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
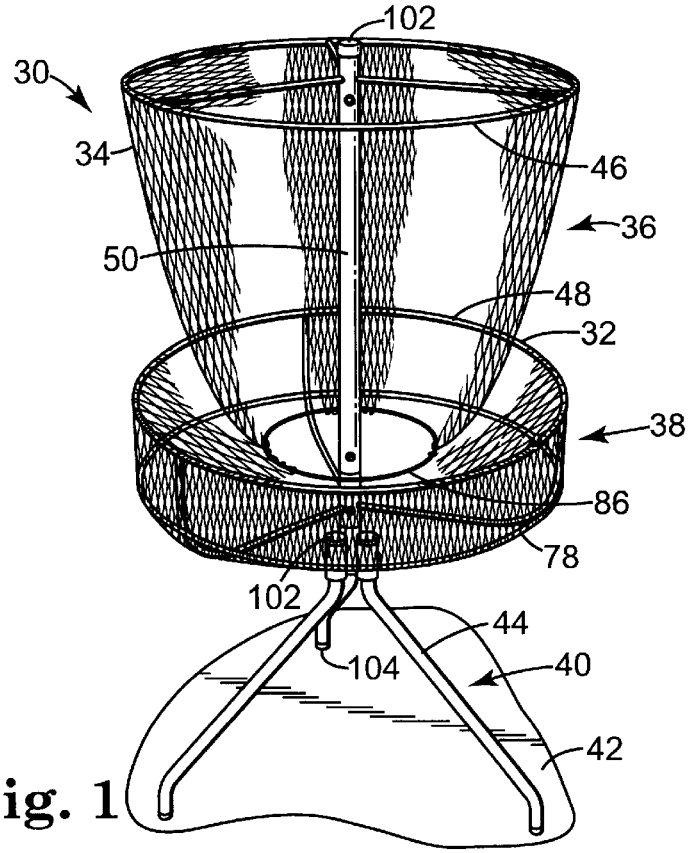
FIG. 1 is a perspective view of one embodiment of a portable 360 degree assembled entrapment device with net attached.

One embodiment of a portable 360 degree assembled entrapment device employing a net according to the present invention is generally illustrated at 30 in FIG. 1. One implementation of the portable entrapment device 30 is to entrap flying discs, such as flying discs employed in disc golf.

Other embodiments of an entrapment device according to the present invention could be used as a target for projectile or flying objects other than flying discs where it is desirable to use a 360-degree entrapment device; particularly one constructed using a net. Other possible uses of such constructed entrapment devices could be to entrap golf balls, baseballs, soccer balls, volley balls, tennis balls, footballs, basketballs, hockey pucks, playground balls, or other similar objects. The relative size of such constructed entrapment devices could be smaller or much larger than the entrapment device 30 illustrated in FIG. 1.

Figure 3:
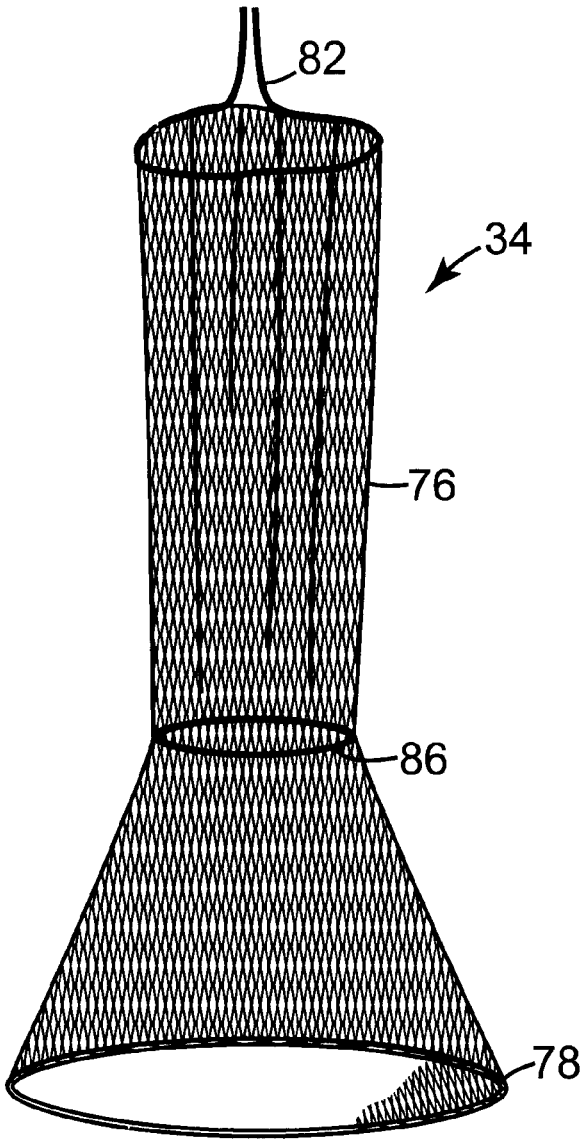
FIG. 3 is a perspective view of one embodiment of a 360 degree net unattached from the 360 degree entrapment device of FIG. 1.

Entrapment device 30 includes an entrapment frame assembly 32 and a net 34 which together form an entrapment zone 36, a basket section 38 and a base section 40. Portions of net 34 are not shown in many of the Figures to more clearly illustrate features of entrapment device 30, but a complete view of one embodiment of an unattached net 34 is shown in FIG. 3. In operation, entrapment zone 36 includes a portion of net 34 which functions as an energy absorbing material to gently and quietly absorb the kinetic energy of the flying discs resulting from the forward motion of the flying discs as well as from the spin of the disc. As a result, when a flying disc is thrown by a player towards the entrapment zone 36, the net 34 is functionally arranged to effectively catch a variety of disc designs, sizes, and weights and at a variety of velocities by absorbing the disc's kinetic energy and dropping the disc into basket section 38. In addition, the flying discs are not easily damaged by the netting of net 34 when the flying discs repeatedly strike the netting.

In the embodiment illustrated in FIG. 1, base section 40 of portable entrapment device 30 comprises a tripod 44. Tripod 44 provides a stable base section 40 for the portable entrapment device 30 on ground or surface 42.

Figure 2:
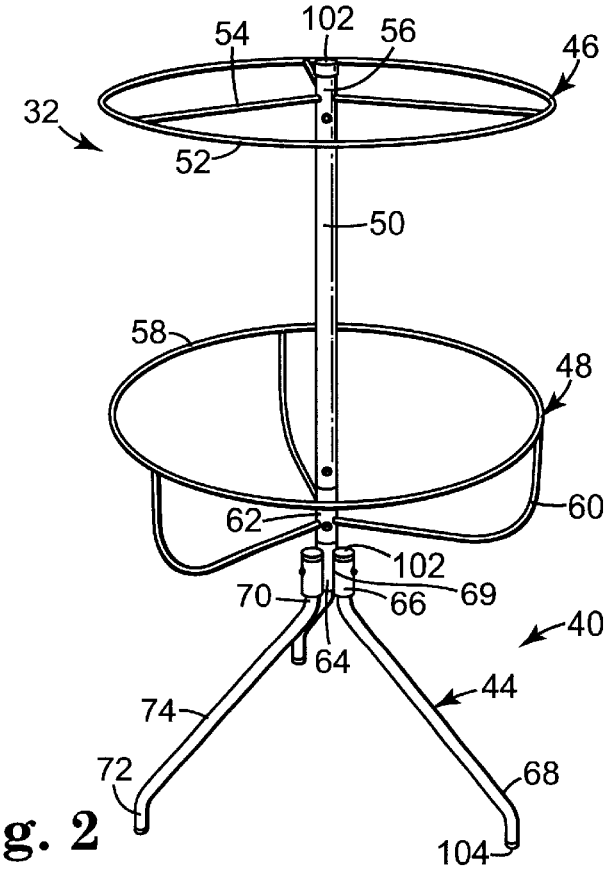
FIG. 2 is a perspective view of one embodiment of an entrapment frame assembly of the entrapment device of FIG. 1.

One embodiment of portable entrapment frame assembly 32 of entrapment device 30 is illustrated generally in FIG. 2. Portable entrapment frame assembly 32 includes a top basket support 46, a bottom support basket support 48, a central support tube 50, and base section 40 comprising tripod base 44. In the illustrated embodiment, top basket support 46 includes a top basket ring 52 attached with three straight radially extending top basket spokes 52 to a top basket central tubing 56. In the illustrated embodiment, bottom basket support 48 includes bottom basket ring 58 attached with three approximately 90 degree upwardly bent and radially extending bottom basket spokes 60 to bottom basket central tubing 62. In the illustrated embodiment, central support tube 50 couples between the top basket central tubing 56 and bottom basket central tubing 62 to form the center support of entrapment frame assembly 32.

In the illustrated embodiment, tripod base 44 includes tripod central tubing 64 which is coupled to the bottom end of bottom basket central tubing 62 to couple tripod base to entrapment frame assembly 32. Tripod base 44 also includes three tripod leg mount tubings 66 attached (e.g., via welding, such as indicated at 69) to tripod central tubing 64 at points approximately 120 degrees from each other. In the illustrated embodiment, three tripod legs 68 are attached into the three corresponding tripod leg mount tubings 66.

In one example embodiment, tripod legs 68 each have an upper end section 70, a lower end section 72, and a middle section 74. Upper end section 70 is coupled into a corresponding tripod leg mount tubing 66. In one embodiment, middle section 74 extends at an approximately 45 degree angle from upper end section 70 and correspondingly at the same approximately 45 degree angle from the corresponding tripod leg mount tubing 66. In this embodiment, lower end section 72 extends at an approximately 45 degree angle downwardly from middle section 74 to form a vertically upright foot of tripod base 44 which contacts ground 42 at an approximately 90 degree angle and is substantially parallel to upper end section 70 and correspondingly parallel to its corresponding tripod leg mount tubing 66. In one embodiment, lower end sections 72 of the three tripod legs 68 are located outside of a diameter of bottom basket ring 58 so as to provide adequate support for the assembled portable entrapment device 30.

In one embodiment illustrated in FIG. 3, a knot-less nylon netting 76, such as a nylon golf netting, typically used for hitting golf balls into, is sewn into a tube shape to thereby form a suitable net 34. The nylon golf netting used to form net 34 in this embodiment provides a durable, yet flexible, soft, and quiet entrapment apparatus. One suitable type of netting 76 is $^{15}/_{16}{}^{th}$ inch square mesh number 252 knot-less nylon netting.

The circumference of net 34 is preferably larger than the circumference of the top basket ring 52 to allow entrapment device 30 to entrap flying discs more effectively than a smaller sized net. One example embodiment of net 34 has a circumference which is approximately three times its height (e.g., circumference of $120^{15}/_{16}{}^{th}$ inch square meshes and height of $43^{15}/_{16}{}^{th}$ inch square meshes).

Figure 4A:
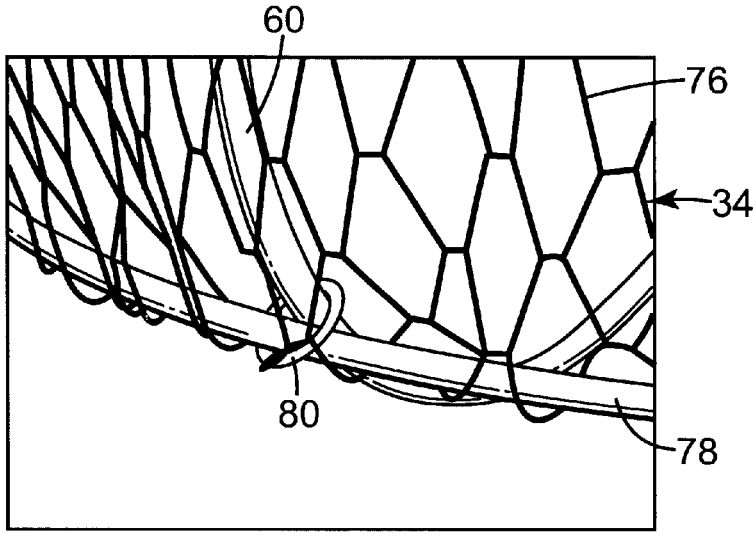
FIG. 4A is a detailed perspective view of one embodiment of a bottom portion of the net of FIG. 3 illustrating a spring steel ring woven through the net and attached to the entrapment device of FIG. 1.

In one embodiment illustrated in detail in FIG. 4A, a spring steel ring 78 is threaded through a bottom mesh row of net 34 and attached to assembled entrapment device 30 at the three approximately 90 degree bent bottom basket spokes 60 with cable ties 80 or other suitable attachment means, such as string or clips. Spring steel ring 78 allows the bottom of net 34 to remain in relatively the same position when the entrapment device is employed to entrap flying discs.

Figure 4B:
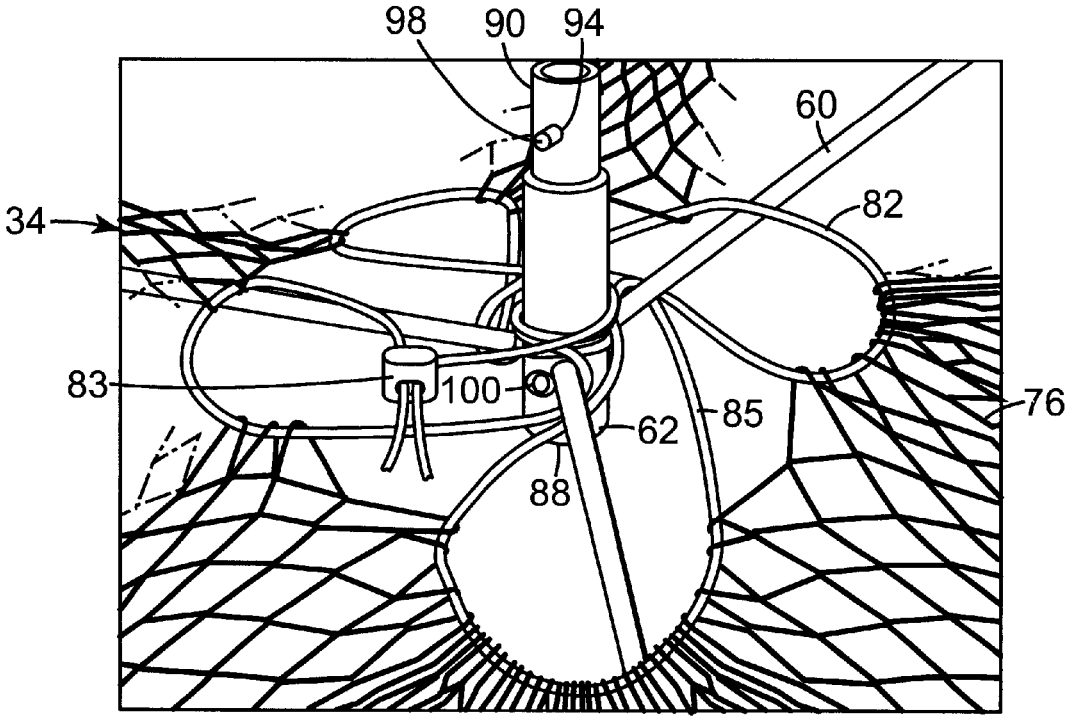
FIG. 4B is a detailed perspective view of one embodiment of a bottom portion of a net attached to an entrapment device via cording woven through the net and employing an adjustable cord lock to synch the cording.

As illustrated in detail in FIG. 4B, an alternative embodiment of the bottom of net 34 does not use a spring steel ring at the bottom mesh row and instead the bottom of net 34 is attached to bottom basket support 48 with cording 82, which is woven through the bottom mesh row of net 34 and locked with an adjustable cord lock 83. In this alternative embodiment, cording 82 is pulled into three loops 85 at three substantially equal distant points around the circumference of the bottom of net 34. In one embodiment, the three loops 85 in cording 82 are looped under one corresponding bottom basket spoke 60 and then placed over the top of bottom basket central tubing 62. Cording 82 is threaded through adjustable cord lock 83, which is employed to securely tighten the cording at the top of bottom basket support 48. Attaching the bottom of net 34 in the manner described allows the net to remain in relatively the same position when entrapment device 30 is used to entrap flying discs.

In another alternative embodiment, the bottom of net 34 does not use spring steel ring 78 and is not attached with cording 82. In this alternative embodiment, the bottom of net 34 freely hangs below bottom basket support 48.

Figure 5A:
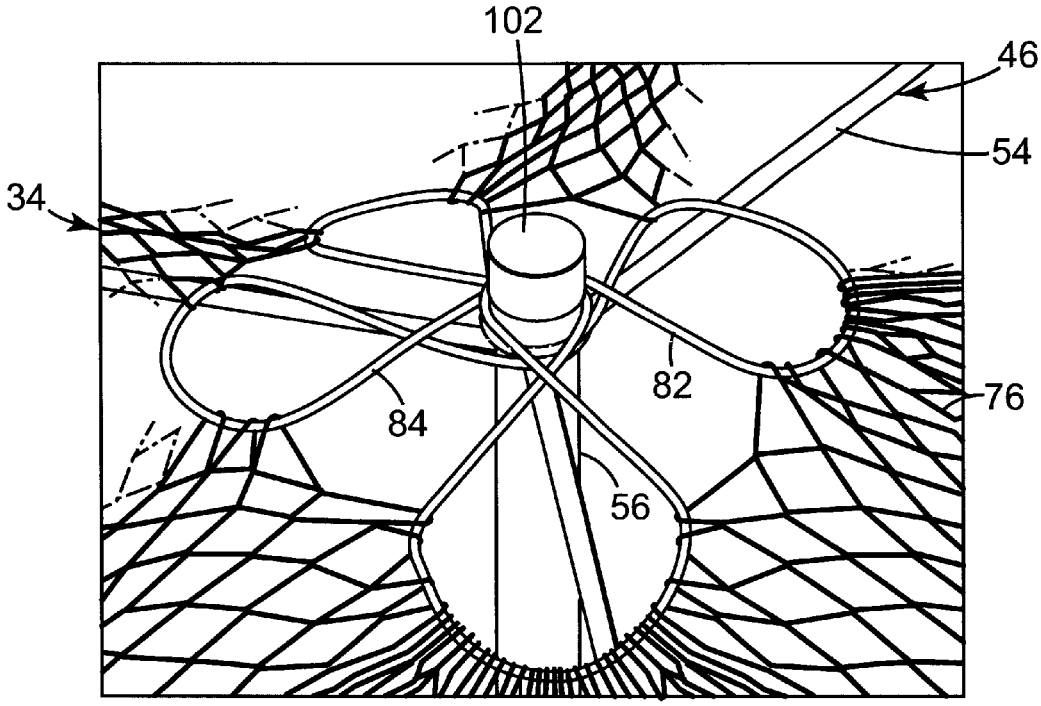
FIG. 5A is a top perspective view illustrating one embodiment of a top of the net of FIG. 3 attached to the entrapment device of FIG. 1 via cording woven through the net.

As illustrated in detail in FIG. 5A, in one embodiment the top of net 34 is attached to top basket support 46 with a cording 82, which is woven through the top mesh row of net 34. In one embodiment cording 82 is pulled into four loops 84 at four substantially equal distant points around the circumference of the top of the net 34. The four loops 84 in cording 82 are then placed over the top of top basket central tubing 56. Attaching the top of net 34 in the manner described allows the net to remain in relatively the same position when entrapment device 30 is used to entrap flying discs.

Figure 5B:
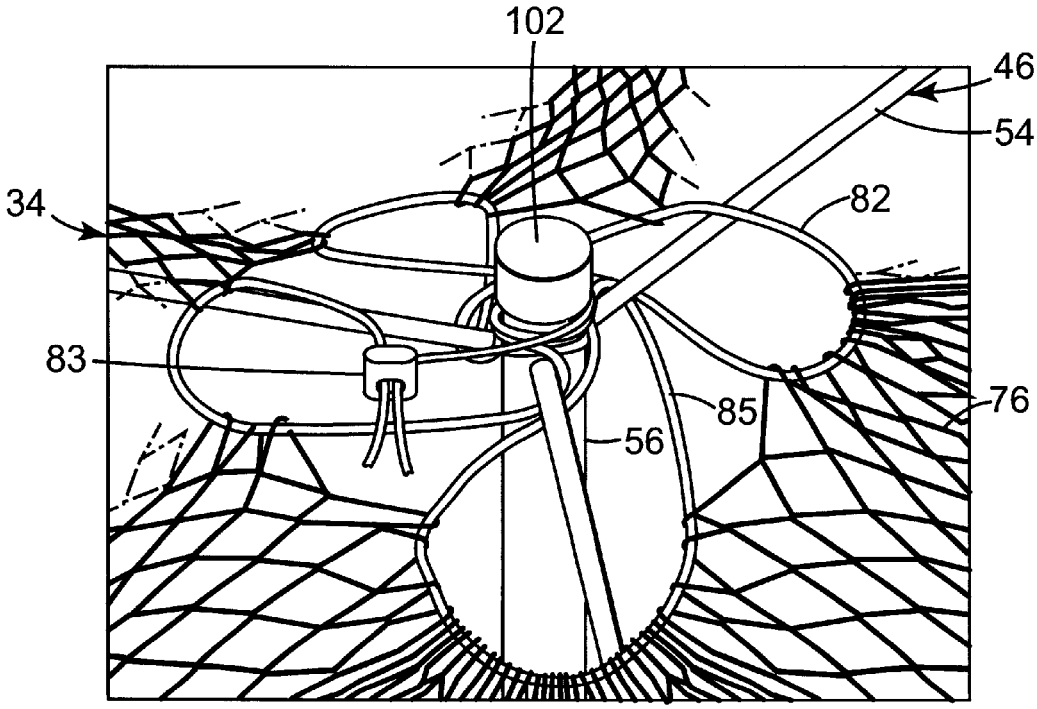
FIG. 5B is a top perspective view illustrating one embodiment of a top of a net attached to an entrapment device via cording woven through the net and employing an adjustable cord lock to synch the cording.

As illustrated in detail in FIG. 5B, in an alternative embodiment the top of net 34 is attached to top basket support 46 with cording 82, which is woven through the top mesh row of net 34 and locked with an adjustable cord lock 83. In this alternative embodiment, cording 82 is pulled into three loops 85 at three substantially equal distant points around the circumference of the top of the net 34. In one embodiment, the three loops 85 in cording 82 are looped under one corresponding top basket spoke 54 and then placed over the top of top basket central tubing 56. Cording 82 is threaded through adjustable cord lock 83, which is employed to securely tighten the cording at the top of top basket support 46. Attaching the top of net 34 in the manner described allows the net to remain in relatively the same position when entrapment device 30 is used to entrap flying discs.

Figure 6:
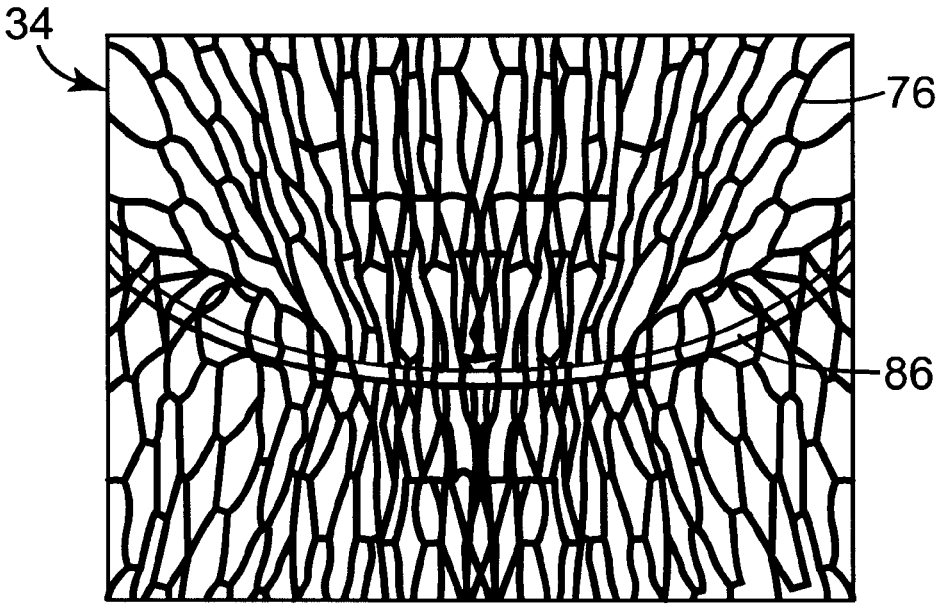
FIG. 6 is a perspective view of one embodiment of a center portion of the net of FIG. 3 with braided cable woven through the net.

As illustrated in detail in FIG. 6, in one embodiment a plastic sheath covered braided-metal cable 86 is threaded through net 34 so that the braided-metal cable 86 is positioned in the inside bottom of bottom basket support 48 when entrapment device 30 is assembled. The braided-metal cable 86 acts as a positioning device for net 34 and also helps to absorb some of the kinetic energy of flying discs thrown into entrapment device 30.

Figure 7:
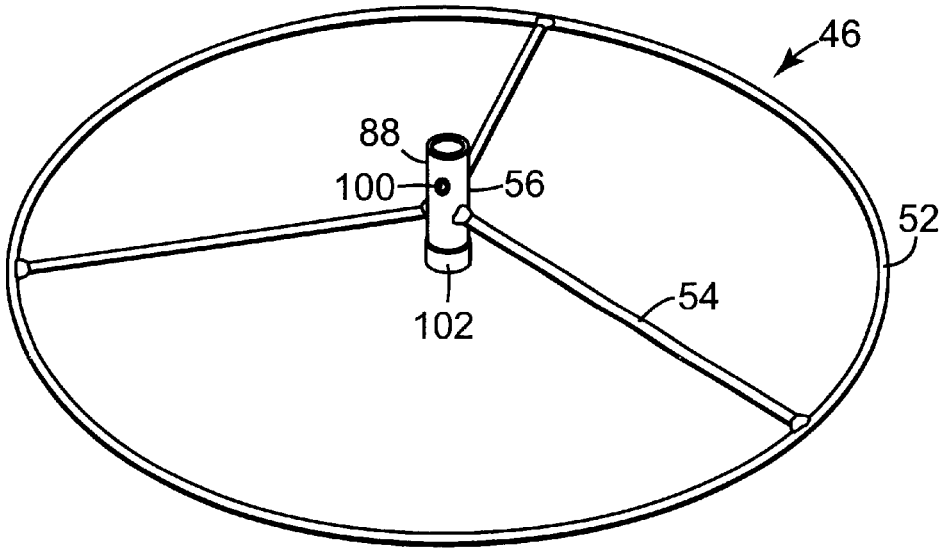
FIG. 7 is a bottom perspective view of one embodiment of a top basket support of the entrapment frame assembly of FIG. 2.
Figure 8:
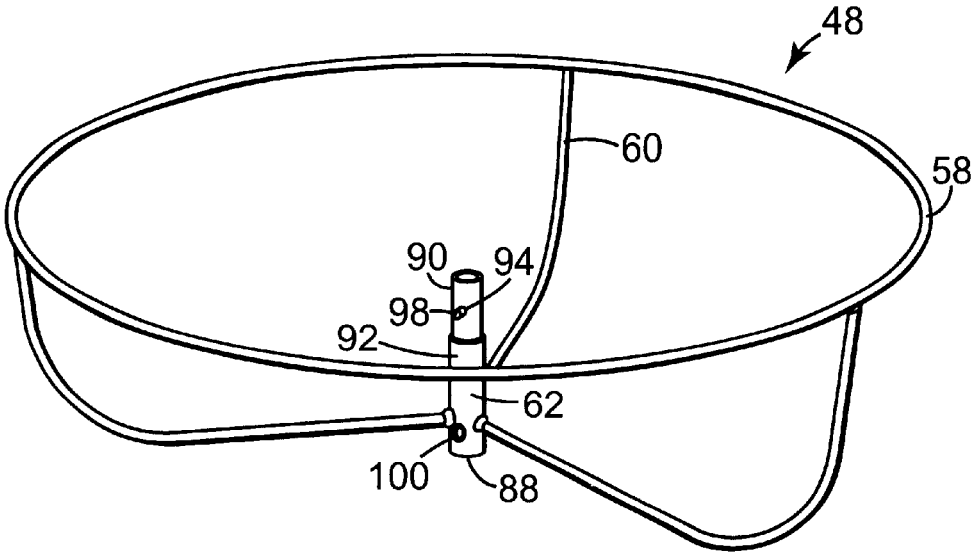
FIG. 8 is a top perspective view of one embodiment of a bottom basket support of the entrapment frame assembly of FIG. 2.
Figure 9:
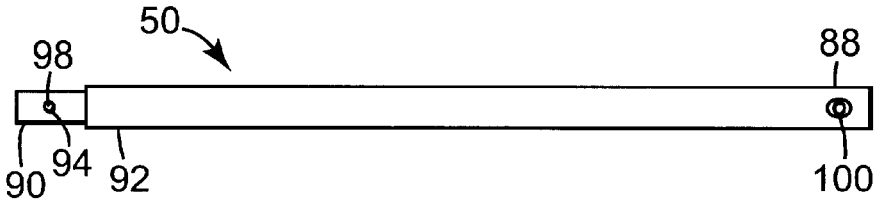
FIG. 9 is a side view of one embodiment of a center support tube of the entrapment frame assembly FIG. 2.
Figure 10:
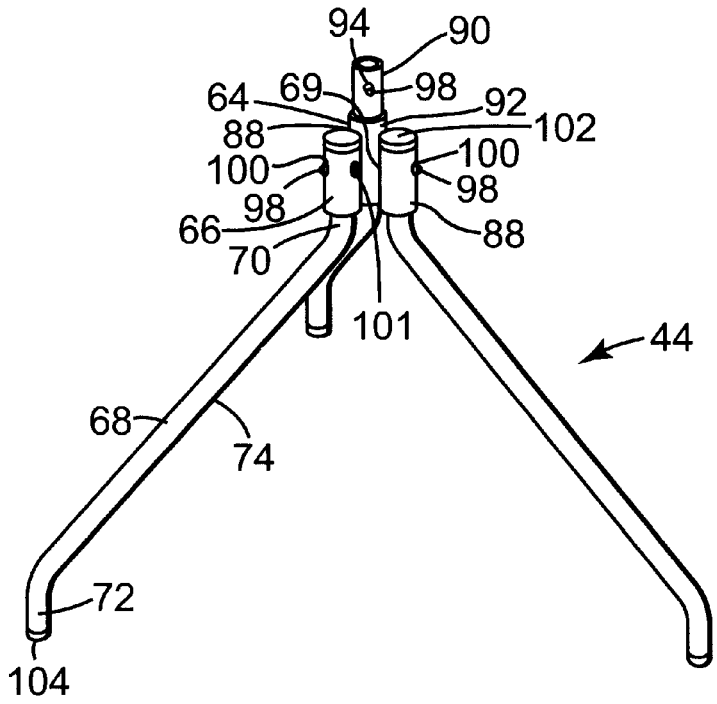
FIG. 10 is a perspective view of one embodiment of an assembled and extended tripod of the entrapment frame assembly of FIG. 2.

FIGS. 7–13 illustrate subassemblies and components of one embodiment of a disassembled portable entrapment frame assembly 32. In particular, FIG. 7 illustrates one embodiment of a top basket support 46. FIG. 8 illustrates one embodiment of a bottom basket support 48. FIG. 9 illustrates one embodiment of a central support tube 50. FIG. 10 illustrates one embodiment of a tripod base 44 in an expanded standing position.

Figure 11:
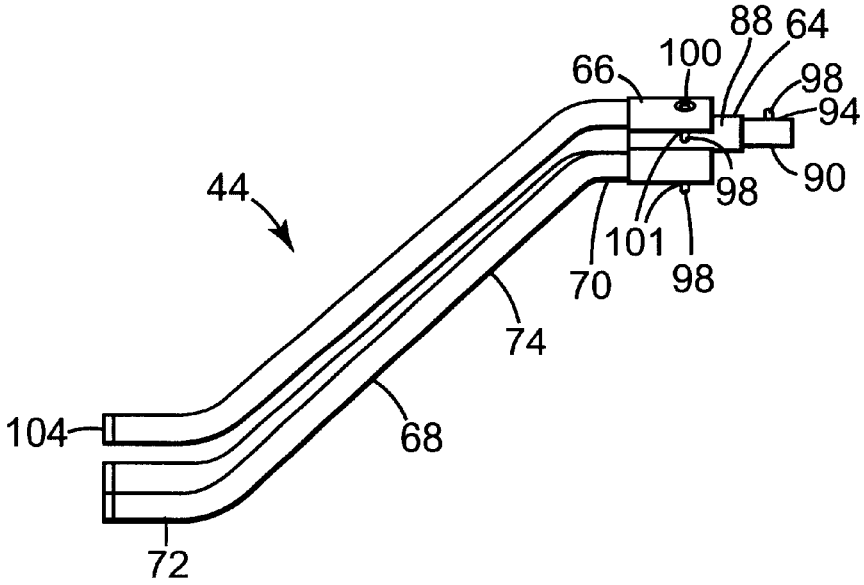
FIG. 11 is a perspective view of one embodiment of a collapsed tripod of the entrapment frame assembly of FIG. 2.

As illustrated in FIG. 11, tripod legs 68 of the tripod base 44 can be nested down to allow the tripod base to fit into a much smaller area, which is a benefit when transporting entrapment device 30.

As illustrated in FIGS. 7–11, in one embodiment of entrapment frame assembly 32, top basket central tubing 56, bottom basket central tubing 62, central support tube 50, tripod central tubing 64, and tripod leg mount tubings 66 all comprise an outer type tubing 88. In addition, each of the above described tubing to tubing attachment points employs an inner type tubing 90 of smaller diameter than outer type tubing 88. In the embodiment illustrated in FIGS. 7–11, inner type tubing 90 is fixedly attached to the top end of central support tube 50 to correspondingly fit into the bottom of outer type tubing 88 of top basket central tubing 56. Inner type tubing 90 is fixedly attached to the top end of outer type tubing 88 of bottom basket central tubing 62 to be inserted into the bottom of outer type tubing 88 of central support tube 50. Similarly, inner type tubing 90 is also fixedly attached into outer type tubing 88 of tripod central tubing 64 to be inserted into the bottom end of outer type tubing 88 of bottom basket central tubing 62.

In one embodiment, inner type tubing 90 is fixedly attached into the top end of central support tube 50, the top end of bottom basket central tubing 62, and the top end of tripod central tubing 64 by plug welding, as indicated 92, into the inside of the corresponding outer type tubing 88. In one embodiment, each of the inner type tubings 90 have a hole 94 formed (e.g., by drilling) through a side wall in one location.

Figure 12:
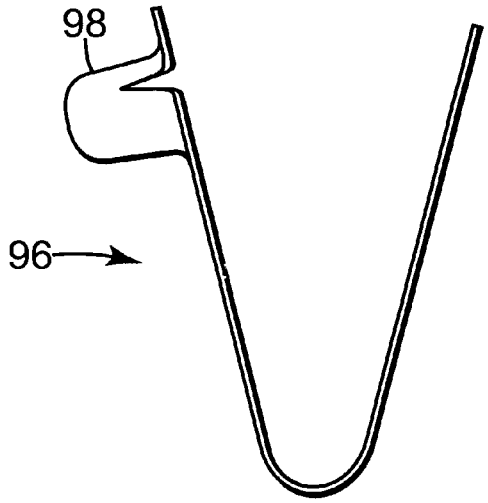
FIG. 12 is a side view of a U-shaped spring clip insertable into tubing for attaching tubing in the entrapment frame assembly of FIG. 2.

One embodiment of a U-shaped spring clip is generally illustrated at 96 in FIG. 12. U-shaped spring clip 96 includes a protruding male connector portion 98.

Figure 13:
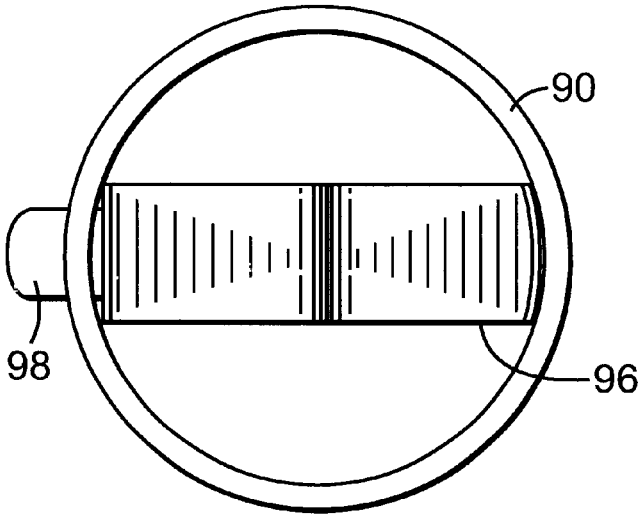
FIG. 13 is a top view of the U-shaped spring clip of FIG. 12 inserted into tubing of the entrapment frame assembly of FIG. 2.

As illustrated in FIG. 13, U-shaped spring clip 96 is inserted into the inner type tubings 90 such that the protruding male connector portion 98 of the spring clip 96 protrudes through hole 94 formed in the inner type tubing 90. Additionally, as illustrated in FIGS. 7–9, at the tubing to tubing connection points, each of the outer type tubings 88 of top basket central tubing 56, bottom basket central tubing 62, and central support tube 50 have a hole 100 formed (e.g., by drilling), through a side wall at the bottom end of the outer type tubings 88.

At the tubing to tubing connections points between central support tube 50 and top basket central tubing 56, between central support tube 50 and bottom basket central tubing 62, and between bottom basket central tubing 62 and tripod central tubing 64, the protruding male connector portion 98 of U-shaped spring clip 96 is depressed before inserting the inner type tubing 90 into the outer type tubing 88. After the inner type tubing 90 is inserted into the outer type tubing 88 at these three connection points, protruding male connector portion 98 of spring clip 40 protrudes through the corresponding hole 100 in outer type tubing 88 to thereby provide a positive lock for these three tubing to tubing connection points. In one embodiment, the protruding male connector portion 98 of U-shaped spring clip 96 is depressed to release the positive lock at a given connection point between inner type tubing 90 and outer type tubing 88 to allow the given connected components to be separated.

In an example embodiment illustrated in FIGS. 10 and 11, the three tripod legs 68 employ a similar attaching mechanism as described above for the tubing to tubing connections between top basket central tubing 56 and central support tube 50, between central support tube 50 and bottom basket central tubing 62, and between bottom basket central tubing 62 and tripod central tubing 64. However, in the illustrated embodiment, the three tripod legs 68 are the same diameter size as the inner type tubing 90, and therefore, additional inner type tubing 90 does not need to be fixedly attached into the tripod legs. Instead, the tripod legs 68 each have a hole 94 formed (e.g., by drilling) through a side wall in one location.

A U-shaped spring clip 96 is inserted into the upper end section 70 of each tripod leg 68, such that the protruding male connector portion 98 of spring clip 96 protrudes through the hole 94 formed in the upper end section 70 of tripod leg 68. The protruding male connector portion 98 of the U-shaped spring clip 96 is depressed before inserting the smaller diameter tubing of upper end section 70 of tripod leg 68 into the outer type tubing 88 of tripod leg mount tubing 66. A hole 100 is formed (e.g., by drilling) through a side wall of tripod leg mount tubings 66 at a first location. The protruding male connector portion 98 of U-shaped spring clip 96 protrudes through hole 100 in outer type tubing 88 of tripod leg mount tubing 66 to thereby provide a positive lock for the connection between tripod legs 68 and tripod leg mount tubings 66.

In one embodiment, the protruding male connector portion 98 of U-shaped spring clip 96 is depressed to release the positive lock at a given connection point between the smaller diameter tubing of tripod leg 68 and the outer type tubing 88 of tripod leg mount tubing 66 to allow the tripod legs 68 to be separated from the tripod leg mount tubing or to be rotated into the collapsed nested position illustrated in FIG. 11. In one embodiment illustrated in FIGS. 10 and 11, a second hole 101 substantially similar to hole 100 is formed (e.g., by drilling) through a side wall of tripod leg mount tubing 66 at a second location. In this embodiment, when the tripod legs 68 are rotated to the collapsed position two of the tripod legs 68 have there corresponding protruding male connector portion 98 of U-shaped spring clip 98 protrude through hole 101 in outer type tubing 88 of tripod leg mount tubing 66 and the other tripod leg 68 has its corresponding protruding male connector portion 98 of U-shaped spring clip 96 protrude through hole 100 in outer type tubing 88 of tripod leg mount tubing 66 to thereby provide a positive lock for the connection between tripod legs 68 and tripod leg mount tubings 66 in the collapsed nested position illustrated in FIG. 11.

FIGS. 1, 2, 5, 10, and 11 illustrate one embodiment having plugs or caps 102, such as plastic or rubber plugs or caps, inserted into or over the top of top basket central tubing 56 and tripod leg mount tubings 66 so as to prevent water and dirt from entering the tubings. FIGS. 1, 2, 10, and 11 illustrate one embodiment having plugs or caps 104, such as plastic or rubber plugs or caps, inserted into or over the bottom of lower end section 72 of tripod legs 68 so as to prevent water and dirt from entering the tripod legs. The plugs or caps 104 inserted in tripod legs 68 can also prevent flooring from being scratched if entrapment device 30 is used indoors.

For the tubing to tubing attachment points where the inner type tubing 90 is used, in one embodiment the inner type tubing 90 is plug welded, as indicated at 92, into the top of the lower piece of tubing so as to minimize the possible entrance of water (e.g., from rain) into the inside of the tubings 56, 62, 50, and 64.

In one embodiment, entrapment frame assembly 32 is primarily constructed with metal tubing and rod. Other embodiments of entrapment frame assemblies according to the present invention are fabricated with other suitable materials such as PVC, steel rod, tension wire, or a heavier gauge of metal.

Other embodiments of construction details of alternate-material entrapment devices according to the present invention could include various means of attaching the legs to the base and attaching the other components to each other. For example, one embodiment of an entrapment frame assembly employs flanged tubing to construct the entrapment device.

One embodiment of net 34 includes netting 76 treated with a green or black UV protectant. Another embodiment of net 34 includes netting 76 which is dyed using diluted latex paint or other suitable method.

Figure 14:
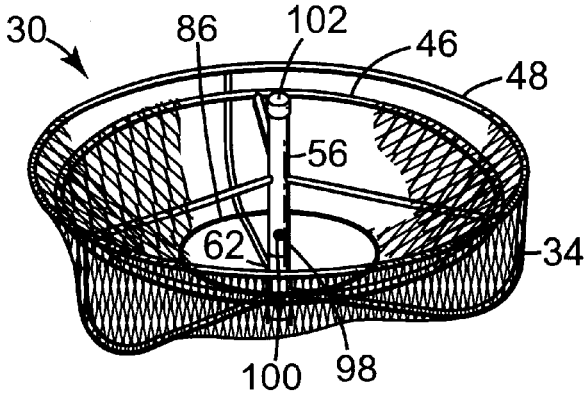
FIG. 14 is a perspective view of one embodiment of a portion of a collapsed 360 entrapment device.

FIG. 14 illustrates one embodiment of a portion of entrapment device 30 with net 34, top basket support 46 and bottom basket 48 collapsed into a portable form. In this embodiment top basket support 46 of entrapment device 30 is disconnectable from central support tube 50 and is connectable to bottom basket central tubing 62 of bottom basket support 48. In one embodiment, as described above, each of the tubing tubing connections points utilizes outer type tubing 88 and inner type tubing 90 of smaller diameter than outer type tubing 88. In this embodiment, top basket support 46 includes outer type tubing 88 to enable top basket central tubing 56 to be connected to the inner type tubing 90 fixably attached to bottom basket central tubing 62 in a similar connection mechanism as employed in the assembled entrapment frame assembly 32 to couple the top end of central support tube 250 to top basket central tubing 56 and to couple the bottom end of central support tube 50 to bottom basket central tubing 62 utilizing the U-shaped spring clip 96. Top basket support 46 being coupled to bottom basket support 48 provides a benefit when transporting entrapment device 30. Moreover, in the embodiment illustrated in FIG. 14, the collapsed tripod 44 illustrated in FIG. 11 and the removed central support tube 50 can be nested into bottom basket support 48, which is also a benefit when transporting entrapment device 30. Furthermore, flying discs can be stored in the nested bottom basket support 48.

Figure 15:
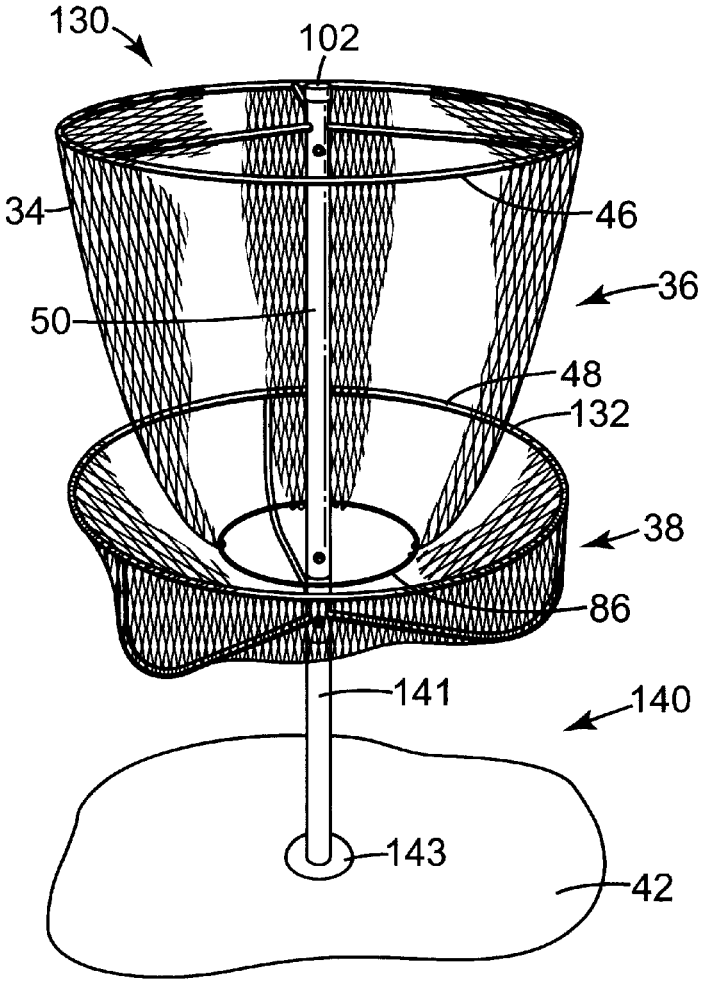
FIG. 15 is a perspective view of one embodiment of a 360 degree assembled entrapment device with net attached which is mounted in an upright position in the ground via a concrete base.

One embodiment of a fixedly mounted 360 degree assembled entrapment device having a net employed as an entrapment apparatus is generally illustrated at 130 in FIG. 15. 360 degree entrapment device 130 is similar in operation and construction to the portable 360 degree assembled entrapment device 30 illustrated in FIG. 1. Entrapment device 130 includes an entrapment frame assembly 132 and a net 34 which together comprise an entrapment zone 36, a basket section 38, and a base section 140. Entrapment zone 36 and basket section 38 are essentially the same as described above for portable entrapment device 30. Entrapment frame assembly 132 of entrapment device 130, however, includes a base section 140 which includes a straight pole section 141. Straight pole section 141 is fixedly mounted in an upright position in ground 42, such as with a concrete base 143 formed in ground 42.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide, variety of embodiments. This application is intended to cover any adaptations or variations of the preferred embodiments discussed herein. Therefore, it is manifestly intended that this invention be limited only by the claims and the equivalents thereof.

What is claimed is:

1. An entrapment device for entrapping projectile or flying objects employed in a game, the entrapment device comprising:

an entrapment frame assembly including:

a top basket support; and a bottom basket support;

a net attachable to the top basket support and having an entrapment zone portion adapted to absorb kinetic energy from the projectile or flying object to cause the projectile or flying object to drop into and be entrapped in the bottom basket support; and a positioning device attached to the net and positioned in an inside bottom of the bottom basket support when the entrapment device is assembled, wherein the entrapment zone portion of the net extends from the top basket support to the positioning device.

2. The entrapment device of claim 1 wherein the entrapment zone portion of the net is substantially 360 degrees.

3. The entrapment device of claim 1 wherein the entrapment device is adapted to entrap flying discs.

4. The entrapment device of claim 1 wherein the net has a bottom basket portion which is supported by the bottom basket support and which holds the entrapped projectile or flying object.

5. The entrapment device of claim 1 wherein the entrapment frame assembly further includes:

a central support adapted to couple the top basket support to the bottom basket support.

6. The entrapment device of claim 5 wherein the central support is removeably attachable to the top basket support and the bottom basket support.

7. The entrapment device of claim 6 wherein a detached central support fits within the bottom basket support.

8. The entrapment device of claim 1 wherein the entrapment frame assembly further includes:

a base section supporting the bottom basket support.

9. The entrapment device of claim 8 wherein the base section includes a tripod base.

10. The entrapment device of claim 9 wherein the tripod base includes a locking mechanism configured to lock the tripod in an upright standing position.

11. The entrapment device of claim 9 wherein the tripod base includes a locking mechanism configured to lock the tripod in a collapsed nested position.

12. The entrapment device of claim 9 wherein the tripod base fits into the bottom basket support in a collapsed nested position.

13. The entrapment device of claim 1 wherein top basket support is removeably attachable to the bottom basket support in a nested position within the bottom basket support.

14. The entrapment device of claim 8 wherein the base section is adapted to be fixedly mounted into a ground.

15. The entrapment device of claim 1 wherein the net includes knot-less nylon netting.

16. The entrapment device of claim 1 wherein the net includes netting having approximately 15/16 inch square meshes.

17. The entrapment device of claim 1 wherein the net includes netting treated with UV protectant.

18. The entrapment device of claim 1 wherein the net includes dyed netting.

19. The entrapment device of claim 1 wherein the net has a tubular shape.

20. The entrapment device of claim 19 wherein the net has circumference which is greater than its height.

21. The entrapment device of claim 20 wherein the net has circumference which is approximately three times greater than its height.

22. The entrapment device of claim 1 wherein the positioning device comprises:

a cable threaded through the net so that cable is positioned in an inside bottom of the bottom basket support when the entrapment device is assembled.

23. The entrapment device of claim 1 wherein the positioning device is adapted to absorb some of the kinetic energy from the projectile or flying object.

24. The entrapment device of claim 22 wherein the cable comprises a plastic sheath covered braided-metal cable.

25. The entrapment device of claim 1 further comprising:

cording woven through a top mesh row of the net to attach the net to the top basket support.

26. The entrapment device of claim 25 further comprising;

an adjustable cord lock adapted to securely tighten the cording at the top basket support.

27. The entrapment device of claim 1 wherein a circumference of a fully extended net is substantially larger than a circumference of the top basket support.

28. The entrapment device of claim 27 wherein a circumference of a fully extended net is substantially larger than a circumference of the top basket support.

29. An entrapment device comprising: a net adapted to entrap projectile or flying objects employed in a game a bottom basket support adapted to support a bottom portion of the net to thereby form a bottom basket; and a top basket support adapted to support a top portion of the net to thereby form an entrapment zone portion in the net which extends from the top basket support to an inside bottom of the bottom basket support and absorbs kinetic energy from the projectile or flying object to cause the projectile or flying object to drop into and be entrapped in the bottom basket.

30. The entrapment device of claim 29 wherein the entrapment zone portion of the net is substantially 360 degrees.

31. The entrapment device of claim 29 wherein the entrapment zone portion of the net includes knot-less nylon netting.

32. The entrapment device of claim 29 wherein the net is adapted to entrap flying discs.

33. The net of claim 29 further comprising:

a bottom basket portion which is supported by the bottom basket support and which holds the entrapped projectile or flying object.

34. The entrapment device of claim 29 wherein the net has a tubular shape.

35. The entrapment device of claim 34 wherein the net has circumference which is greater than its height.

36. The entrapment device of claim 35 wherein the net has circumference which is approximately three times greater than its height.

37. The entrapment device of claim 29 further comprising:

a cable threaded through the net so that cable is positioned in an inside bottom of the bottom basket support when the entrapment device is assembled.

38. The entrapment device of claim 36 wherein the cable is adapted to act as a positioning device for the net to absorb some of the kinetic energy from the projectile or flying object.

39. A method of playing disc golf comprising:

throwing a flying disc toward an entrapment device including an entrapment frame assembly having a top basket support and a bottom basket support;

absorbing kinetic energy from the flying disc with an entrapment zone portion of a net attached to the top basket support, the entrapment zone portion extending from the top basket support to a positioning device attached to the net and positioned in an inside bottom of the bottom basket support;

absorbing kinetic energy from the flying disc with the positioning device; and entrapping the flying disc in the bottom basket support.

* * * * *